United States Patent [19]

Noonan

[11] 4,014,774

[45] Mar. 29, 1977

[54] PLASTIC ELECTROPLATING BARREL WITH RIBBED PERFORATE MODULAR PANELS

[75] Inventor: Walter F. Noonan, Wallingford, Pa.

[73] Assignee: Westlake Plastics Co., Lenni, Pa.

[22] Filed: Dec. 31, 1975

[21] Appl. No.: 645,643

Related U.S. Application Data

[62] Division of Ser. No. 481,220, June 20, 1974, Pat. No. 3,953,633.

[52] U.S. Cl. ..... 204/213; 118/418; 134/159; 259/89

[51] Int. Cl.[2] ..... C25D 17/20

[58] Field of Search ..... 204/213, 214; 118/418; 134/159; 428/131, 167, 361, 403, 406, 500; 259/89

[56] References Cited

UNITED STATES PATENTS

| | | | |
|---|---|---|---|
| 2,004,935 | 6/1935 | Dorn et al. | 428/131 X |
| 3,205,159 | 9/1965 | Neilson | 204/213 |
| 3,340,170 | 9/1967 | Marulli et al. | 204/213 |
| 3,379,632 | 4/1968 | Henig | 204/213 |
| 3,498,902 | 3/1970 | Wojtanek | 204/213 |
| 3,582,523 | 6/1971 | Linnhoff | 204/213 |
| 3,582,526 | 6/1971 | Campana | 204/213 |
| 3,716,470 | 2/1973 | Noonan | 204/213 |

*Primary Examiner*—John H. Mack
*Assistant Examiner*—A. C. Prescott
*Attorney, Agent, or Firm*—Max R. Millman

[57] ABSTRACT

A plastic polehydral electroplating barrel whose rails, end heads and perforate panels are made of a mineral or fiberglass-filled thermoplastic resin, preferably fiberglass-filled polypropylene, in which the perforate panels are made of modules which when abutted edge to edge form the 30 or 36 inch panel, each module being made of a relatively thin perforate plate injection molded to contain an increased number of square drainage holes and a plurality of crossed ribs upstanding from the plate to strengthen it, those edges of the modules which engage in the rail and head grooves being reinforced to reduce load stress at the connecting points. The modules can be held in abutting relation unconnected to each other in the final barrel assembly, or can be interconnected by tongues and grooves, or can be welded together. The ribbed injection molded perforate panels can be used as inserts to make barrel halves or barrel bodies by matched metal low pressure molding.

10 Claims, 10 Drawing Figures

PLASTIC ELECTROPLATING BARREL WITH RIBBED PERFORATE MODULAR PANELS

This is a division of my copending application Ser. No. 481,220 filed June 20, 1974 now U.S. Pat. No. 3,953,633.

This invention relates to electroplating barrels or cylinders in which many small articles are plated at one time and in particular to rotary polyhedral (referred to in the industry as polygonal) barrels with perforated panels through which the electroplating solution is pumped due to rotation thereof.

In applicant's Pat. No. 3,767,554 the perforate panels are one-piece units as long as required in the industry, generally 30or 36, and are made of mineral-filled thermoplastic resins and the longitudinal ribs and heads completing the barrel construction are made of fiberglass-filled thermoplastic resins having a deflection temperature exceeding that of the perforate panel material to substantially eliminate distortion of the panels relative to the ribs when the barrel is operated in the frequent range of 180°–200° F.

In said U.S. Pat. No. 3,767,554, the applicant states that making the panels, ribs or rails and heads all of the same fiberglass-filled polypropylene presents the difficulty that the many perforations required must be drilled by machine therein which provides the disadvantages that this works havoc with the drill bits and also exposes the glass fibers which renders the panels attackable by fluoride plating solutions which are pumped through the perforations as the barrel rotates.

The primary object of the invention is to provide an electroplating barrel which overcomes these disadvantages and is based on applicant's finding that the perforate panels, rails and heads can be made of the same fiberglass or mineral-filled thermoplastic resins if the panels are made of a ribbed construction so that the perforations need not be machined therein, but rather the panels and ther perforations, without the fiberglass or mineral filling exposed through the surfaces of the perforations, can be effectively made by injection molding.

Another object of the invention is to provide an electroplating barrel in which the perforate panels are made of modules of ribbed fiberglass or mineral-filled thermoplastic resin construction which can be assembled edge to edge and firmly retained in the rail grooves and heads to ease assembly and construction of the barrel and to permit accommodation to a variety of barrel sizes.

Another object of the invention is to provide modular ribbed fiberglass or mineral-filled perforate thermoplastic resin panels whose open area, i.e. the area of the perforations, is in the order of magnitude of about twice the open area provided in present panels, thus improving the speed of the plating, draining and rinsing operations.

Another object of the invention is to provide modular ribbed fiberglass or mineral-filled perforate thermoplastic resin panels which are substantially rectangular, contain a gridwork of ribs upstanding from a relatively thin perforate plate, whose flat outer surface becomes the inner surface of the barrel, the ribs being spaced apart at a predetermined distance except that those edges thereof which fit tightly into the rail grooves and heads each have a pair of closely adjacent ribs which fits into the grooves to provide a strong assembly.

Another object of the invention is to provide a modular fiberglass or mineral-filled perforate theremoplastic resin of the character described in which pairs of closely spaced ribs are provided in addition to those at the edges so that the module can be cut at those locations to shorten the module and adapt it for edge to edge assembly into the rail and head grooves to provide an electroplating barrel of shorter dimensions.

Another object of the invention is to provide modular ribbed fiberglass or mineral-filled perforate thermoplastic resin panels wherein the modules can either abut edge to edge, or interengage edge to edge by tongue and groove connection or be welded edge to edge to form the full desired length of perforate panel in the final barrel assembly.

Another object of the invention is to provide modular ribbed fiberglass or mineral-filled perforate panels made by conventional injection molding which can thus be used as inserts and the rails can be molded to contain the panels as an entire unit by a conventional matched metal low pressure molding.

Yet another object of the invention is to provide modular ribbed fiberglass or mineral-filled perforate panels made by conventional injection molding which can thus be used as inserts and half the number of ribs and half of the areas of the head can be molded to contain the panels and provide half of a total barrel which then can be joined with a corresponding half and welded thereto to complete formation of the barrel.

These and other objects of the invention will becomes more apparent as the following description proceeds in conjunction with the accompanying drawing, wherein.

Specific reference is now made to the drawings in which similar reference characters are used for corresponding elements throughout.

Figure 1:
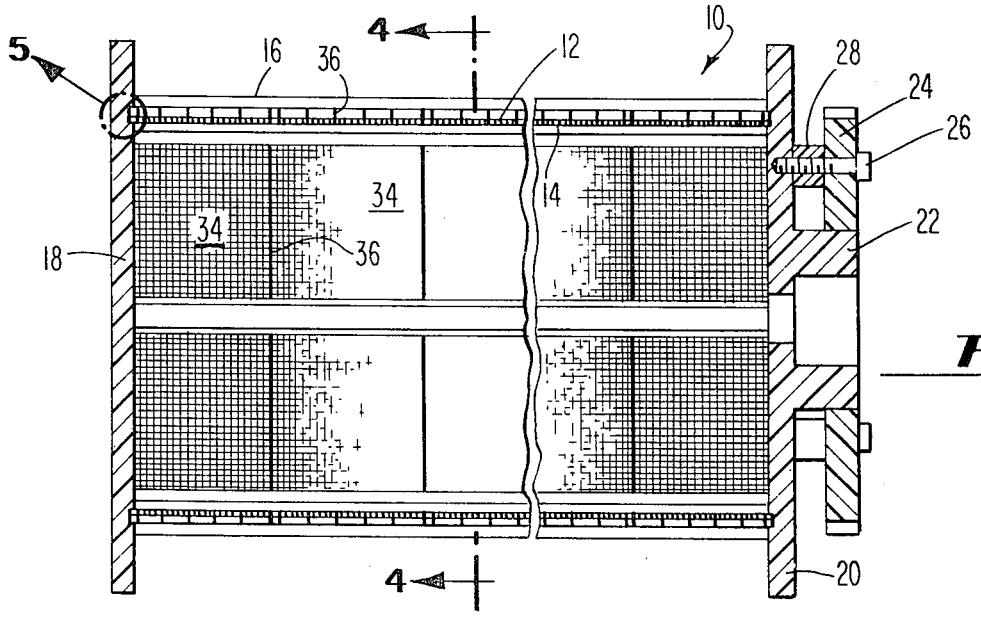
FIG. 1 is a longitudinal sectional view through the electroplating barrel made in accordance with the invention.

The polyhedral barrel, usually hexahedral, but which can have more or less than six sides, is shown generally at 10 and is intended to be suspended by suitable hangers from an overhead rail and rotated horizontally while partially immersed in an electroplating solution. See Electroplating Engineering Handbook, Second Edition, by Graham et al, Chapter 25, entitled "Barrels." Conventionally such a barrel consists essentially of panels 12 having perforations 14 therethrough, nonperforate axially extending rails 16 to which the panels are connected and generally circular end plates, heads or flanges 18 and 20 securing the ribs and perforate panels. The end plates or heads are provided with the usual bearing bosses 22 to suspend the barrel by hangers (not shown) from an overhead rail (not shown), the bosses having bores to provide access for electrodes (now shown) into the barrel.

To rotate the barrel, a gear is associated with one of the heads 20 which is engaged by another gear driven by a suitable overhead motor. In the form of the invention shown, a separate toothed gear wheel 24 is bolted as at 26 to the head 20 with spacers 28 intervening between the head 20 and gear wheel 24. In another conventional form of invention the head itself is provided with peripheral gear teeth. In yet another form of invention no gears are used. Rather, the head is in the form of a pulley having a peripheral groove for engagement by a belt to be driven thereby.

Figure 4:
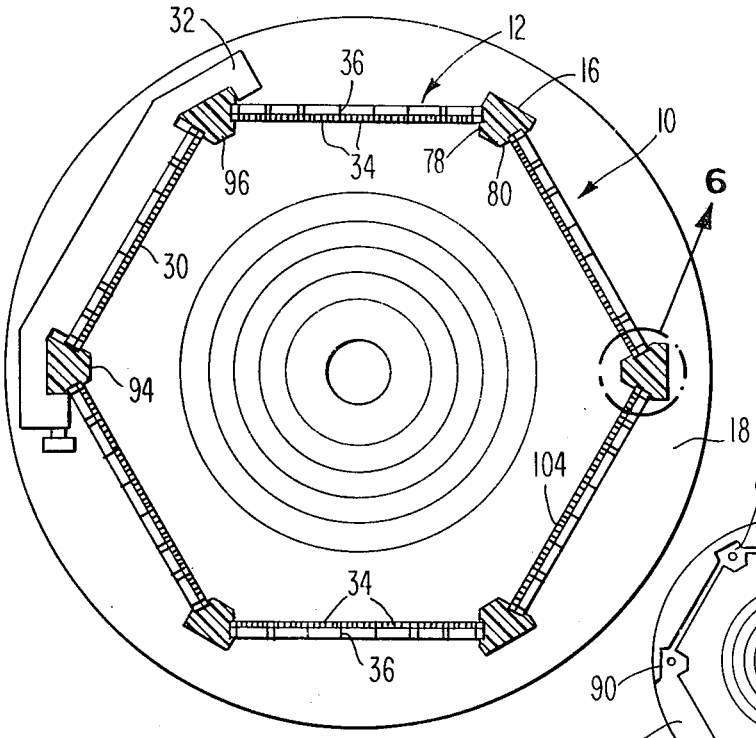
FIG. 4 is a sectional view taken on the line 4—4 of FIG. 1.

The perforate panels form the faces of the polyhedron except that for one face the panel 30 serves as a door for access to the interior of the barrel. As seen in FIG. 4, the door may be as thick or thicker than the panels and is removably supported on the adjacent ribs and there retained by suitable clamping devices 33 well known in the art. See, for exaple, the Neilson U.S. Pat. No. 3,256,170.

The ribs 16 and heads 18 and 20 are made of a thermoplatic resin having good tensile and flexural strength and a deflection temperature under load so that the ribs and heads will not distort until a temperature of about 260° F is attained. It has been found that polypropylene filled with 10–20 percent by weight of fiberglass strands is economical to mold into the ribs and heads, has excellent tensile and flexural strength and deflection temperatures at 264 psi of about 280°–305° F. The glass filled resin is molded in such a manner that the fibers extend beneath the outer surfaces of the ribs and heads to leave areas which are free of the glass fibers or strands, thus minimizing attack on the faces of the ribs and heads which may be exposed to fluorides as disclosed in my aforesaid U.S. Pat. No. 3,767,554.

Other thermoplastic resins having flexural and tensile strengths above that of virgin polypropylene and higher deflection (and hence operating) temperatures which can be used for the ribs and heads are asbestos-filled polypropylene, sold by Hercules Powder as "profax 66FIA" which has a deflection temperature at 264 psi of about 190° F and mineral-(talc) filled polypropylene sold by Hercules Powder as profax 66F3 which has a deflection temperature at 264 psi of about 177° F and about the same filler content, and potassium titanate-filled polypropylene which has a deflection temperature at 264 psi of about 220° F and a filler content of 15–25 percent by weight, preferably 25 percent, the latter product being available from DuPont Co. as "FIbex." The aforementioned glass-filled polyporpylene is superior.

Coming now to the panel 12, according to the instant invention it is made of separate modules 34 which abut edgewise as at 36 in sufficient number of units to make up the total length of panel required be it 30.5 or 36.5, the present conventional sizes. The modules are made of the same mineral or fiberglass-filled thermoplastic resins as those used for the rails and heads, preferably fiberglass-filled polypropylene.

Figure 2:
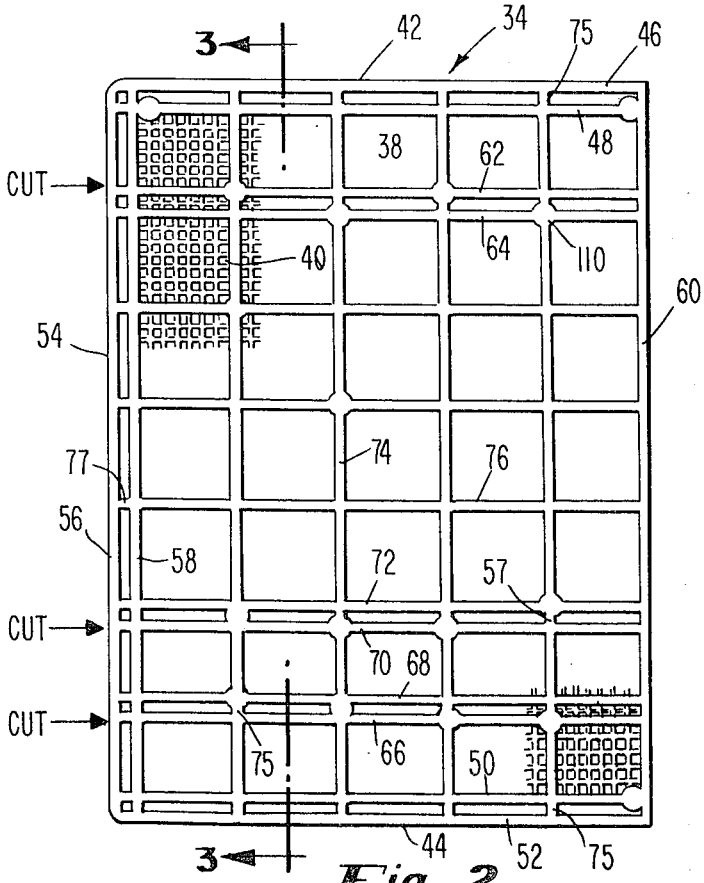
FIG. 2 is a plan view of a perforate panel module per se.
Figure 3:
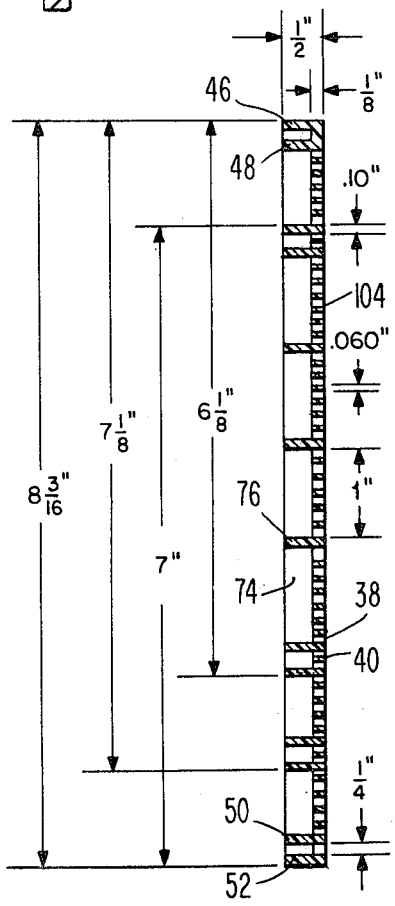
FIG. 3 is a sectional view taken on the line 3—3 of FIG. 2.

As seen more clearly in FIGS. 2 and 3, each module for adaptability to form the aforementioned barrel sizes is injection molded to have an overall width of 8 3/16 and length of 6.090. The module comprises a relatively thin plate 38 which is about ⅛ thick and contains a plurality of square perforations or holes 40 each side of which is about 0.060. In this construction the area of the perforations is about 40% of the overall area of the module as compared to an area of about 22% in the perforated panel construction where the holes are machined therein.

It will be seen that a gridwork of ribs, all of the same depth, i.e. about ⅜ beyond the ⅛ thick perforated plate 38 (yielding an overall thickness for the module of about ½) are formed integrally with the plate, each rib being about 0.10 thick. Along both longitudinal edges 42 and 44, there are two ribs 46, 48 and 50, 52 which are closely spaced, that is, about ¼ apart. Similarly, along one lateral edge 54 of the module there are two ribs 56 and 58 of the same thickness and of the same spacing. The remaining lateral edge is comprised of a single thickness rib 60.

Spaced about 1 from the inner rib 48 of the pair of ribs 46, 48 is another pair of ribs 62, 64, also closely spaced apart about ¼. Towards the other end of the module, spaced about 1 from the inner rib 50 of the pair of ribs 50, 52 is a further pair of ribs 66, 68 closely spaced about ¼ apart, and about 1 from rib 68 is yet another pair of ribs 70, 72 also closely spaced about ¼ apart.

Between the innermost ribs 64, 72 and 58 of the double ribs and the single rib 60 are rectangularly intersecting single longitudinal and lateral ribs 74 and 76 forming substantially square areas about 1 × 1. Thus, the spacing of the single ribs 74 and 76 is considerably greater than that between the double ribs for a reason soon to appear.

Additionally, the single lateral ribs 74 cross the double lateral ribs 46, 48; 50, 52 and 70, 72 to form between each pair of ribs longitudinally spaced short rib portions 75 serving as reinforcements. Similarly, the longitudinal ribs 76 cross the double ribs 56, 58 to form laterally spaced short rib portions 77 also serving as reinforcements.

Each rail 16 which extends axially between the heads 18 and 20 constitutes the apices or corners of the polyhedron. While rails may have any desired profile, a substantially rectangular cross-section is desired with bevels at the interior surface thereof to minimize sharp edges which may injure the items to be plated as they tumble in the electroplating solution during rotation of the barrel. Opening through the opposite axially extending sides 78 and 80 of each rail are substantially U-shaped grooves 82 and 84 which extend at angles to each other equivalent to the interior angle required for completion of the polyhedron when the perforate panels are inserted therein as shown in the drawings. The rail grooves are about ¼ deep by ¼ in width but could range from ¼ to ½ in each dimension.

Figure 7:
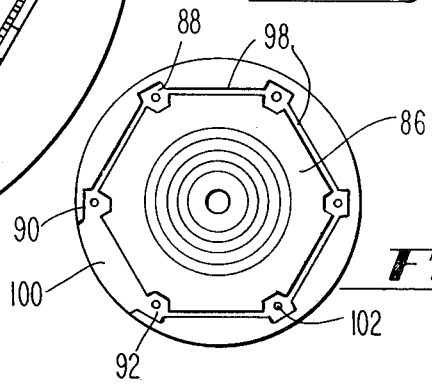
FIG. 7 is an elevational view of the inner face of an end head.

As seen in FIG. 7, the inner surface 86 of each head 18 and 20 is provided with recesses 88 approximating the cross-sectional dimensions and configurations of the rails 16 and recesses 90 and 92 approximating the cross-sectional dimensions and configurations of the door rails 94 and 96. Interconnecting the recesses 88 are grooves 98 which approximate the cross-sectional dimensions and are of the same configuration as the panels 12. A further wider groove 100 which approximates the cross-sectional dimensions and configurations of the door interconnects the recesses 90 and 92. When the ends of the rails are received in their respective recesses 88, 90 and 92 and the ends of the panels in their respective grooves 98, the heads 18 and 20 are then secured as by bolts 102 to the ribs. The grooves and recesses in the head are normally ¼ deep by ¼ wide but can range from ½–¼ in each dimension.

In assembly, each module 42 is positioned so that one longitudinal edge 44 thereof with its double ribs 50 and 52 is press-fitted tightly into the groove 84 of one rail and the opposite longitudinal edge 42 is press-fitted tightly into the groove 82 of the next rail, the lateral single rib 60 abutting a similar rib of an adjacent module until the entire desired length of perforate panel 30 ½ or 36 ½ is obtained. Then the opposed free ends of the rails 16 are press-fitted tightly into their respective recesses 88 in the end heads and the free lateral double ribbed edges 54 of the end remaining modules are press fitted tightly into their respective grooves 98 of the end heads, and when the bolts 102 secure the heads to the ribs, a tight polyhedral barrel results with the smooth face 104 of the perforate panels facing inwardly of the barrel.

Figure 5:
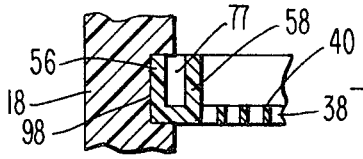
FIG. 5 is an enlarged sectional view of the area 5 of FIG. 1.
Figure 6:
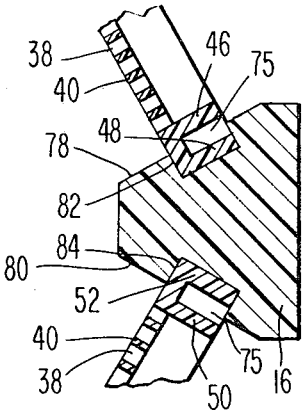
FIG. 6 is an enlarged sectional view of the area 6 of FIG. 4.

Since the dimensions of the double ribs are approximately ½ ×½ and the dimensions of the rail and head grooves and recesses are ¼×¼ as a rule, only the outer of the double ribs and a portion of the plate 38 extend into the grooves as shown in FIGS. 5 and 6. However, the cross-rib portions 75 and 77 also extend partially into the grooves and augment the reinforcement of the connection. Where the rail and head grooves and recesses are ½×½ in depth and width, then both double ribs, the shorter cross ribs and the portion of the plate 38 joining the double ribs will enter the grooves and recesses entirely.

It is believed that the tightened abutment between the lateral edges of the modules will suffice to provide a substantially firm construction. Should one desire to create a more positive interconnection between the modules, the abutting edges of the modules can be pre-welded to form a single +½ or 36 ½ perforate panel. Even in the welded construction, the use of smaller modules affects economy in molding the units.

Figure 8:
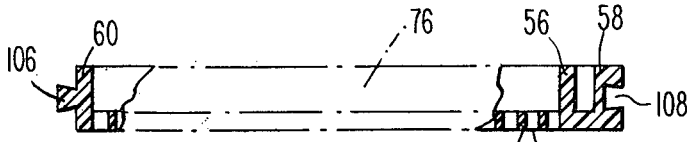
FIG. 8 is a sectional view through another form of perforated panel module.

As an alternative to welding or simply abutting the modules, each module can, as shown in FIG. 8, be formed with a tongue 106 along one lateral edge of the module and a groove 108 along the other edge so that a tongue and groove interconnection between adjacent modules can be readily effected while the edges at the double ribs with the short ribs forming them will extend into the rail and end head grooves and recesses to provide reinforced connections at important load points.

In addition to commerical requirements for electroplating barrels of about 30 and 36 long, 14 and 16 diameter barrels of these lengths are also needed. To permit a standard module as described having an overall length of 8 3/16 to be used to construct barrels of smaller diameter yet assure that the edges containing the double ribs of the modules will be available for engagement in the rail and end head grooves, each module can be cut where indicated in FIG. 2 along the outer rib of the double rib construction. Thus, a cut along the rib 62 will provide a module with an overall width of 7; a cut along the rib 66 will provide a module with an overall width of 7⅛; and a cut at the rib 70 will provide a module with an overall width of 6⅛; and in each case the free edge remaining for insertion into the rail groove will be an edge which contains the double ribs and short spaced cross ribs joining them.

Each of the modules 42 are readily made by conventional injection molding in which the cavity contains a plurality of pins to form the perforations 40. It will be noted that the module contains several larger circular flat areas 110 at some of the rib intersections. These are knock-out pins for the removal of the module from the mold, and because of the size of the module, namely 8½× 6.090 × ½, the cost of injection molding the same is relatively inexpensive.

Figure 9:
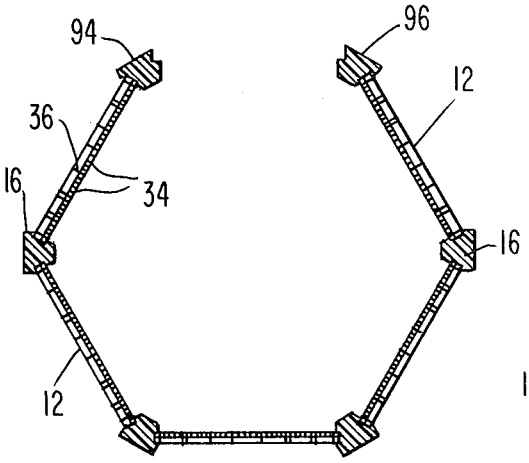
FIG. 9 is a sectional view of a barrel minus the end heads formed in accordance with the invention.
Figure 10:
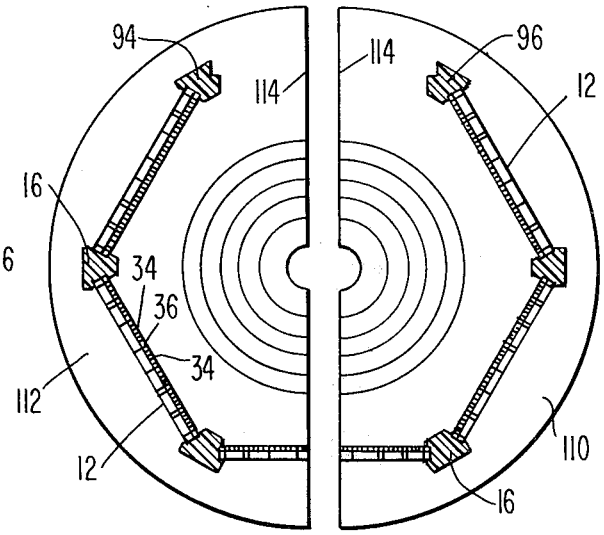
FIG. 10 is a sectional view of two corresponding halves of a barrel including the end heads formed in accordance with the invention.

The economy and versatility of the invention is further evidenced by the fact that the modular ribbed perforate panel construction can be used to mold the entire body of the barrel as seen in FIG. 9 or the entire barrel including the end heads in two halves that can then be welded together, as shown in FIG. 10.

In the case of the unit shown in FIG. 9, a mold is formed with spaced longitudinal recesses corresponding to the rails 16, the door rails 94 and 96 with grooves 82 and 84 extending from opposite edges of the recess. The modules 42 are placed in lateral abutting edge relationship and their free longitudinal edges are inserted into the grooves 82 and 84 of the rail recesses. Then using conventional matched metal low pressure molding, the rails 16 and door rails 94 and 96 are molded and, when the unit is removed from the mold, it comprises the longitudinal rails 16 and door rails 94 and 96 and the panels 12, made of the modules, already in place. Applicant has found that the matched metal low pressure molding process, which is conventional, is especially adapted for making the units of FIGS. 9 and 10 and the process comprises essentially making two corresponding halves of a metal, usually aluminum mold with the desired cavities and grooves formed therein, clamping the halves manually, attaching the clamped mold to the delivery end of an extruder into which molten plastic is pressed, in this case mineral or fiberglass-filled polypropylene or other suitable thermoplastic resin, cooling the mold slowly under pressure to stress relieve the material formed therein and then opening the mold and removing the formed part.

After the body unit of FIG. 9 is formed which consists of interconnected rails and perforate panels, the end heads 18 and 20 with the grooves and recesses 88, 90, 92 and 98, see FIG. 7, formed therein are positioned at the ends of the unit of FIG. 9 and the free ends of the panels are pressed into the grooves 98, the rails 16 pressed into the recesses 88 and the door rails 94 and 96 pressed into the recesses 90 and 92 and there secured by bolting the heads to the rails as at 102 to complete the assembly.

The unit of FIG. 10 is also made by the aforedescribed matched metal low-pressure molding process except that in this case each mold half contains spaced semi-circular end head cavities joined by rail recesses, each semi-circular cavity having panel grooves therein connecting the rail recesses. The rail recesses each contain grooves opening through opposite edges thereof.

The panel modules 34, having been previously injection molded, are placed in each mold half in laterally abutting relationship as inserts and are retained at their longitudinally edges in the grooves of the rail recesses and panel grooves of the end head cavities, and then the mold halves are clamped. When the mineral or fiberglass-filled thermoplastic resin is extruded under pressure into the clamped molds, the rails and heads are formed with the modular panels in place and, after cooling under pressure and opening of the mold, one half of a plastic electroplating barrel 112 is formed containing the rails, panels and end heads. When both halves 112 are then welded along their axial meeting edges 114, a complete polyhedral barrel is formed such as that shown in FIGS. 1 and 4.

In both barrels formed, as shown in FIGS. 9 and 10, the barrel is ultimately provided with a door 30 which is clamped to the rails 94 and 96. The door can be a perforate member made of the ribbed modular units 34 but in this case the units would have to be welded to each other to form a unitary member. The invention is also capable of being used with standard non-ribbed doors thicker than the perforate panels 12 as is now conventional.

While preferred embodiments have here been shown and described, a skilled artisan may make variations without departing from the spirit of the invention and the scope of the appended claims. Thus, for example, the end heads may be secured to the rail and perforate panels by thermal fusion instead of by bolts as shown in the drawings. Additionally, where on has decided to use a standard size of electroplating barrel, such for example as a 36 barrel, it is within the purview of the invention to injection mold the perforate panel as a single ribbed unit of 36½ in length, with the thickness and width of the perforate plate and the ribs being the same as previously described for members 38, 74 and 76 except that there will be double ribs, such as 46 and 48 and 50 and 52 along the entire length of the 36½ panel for receipt in the rail grooves 82 and 84, and there will be double ribs such as 56 and 58 at both lateral or end edges of the entire 36½ panel for receipt in the end head grooves 98 for reinforced connections of the rails, panels and end heads as described hereinbefore.

What is claimed is:

1. A polyhedral electroplating barrel having longitudinal rails forming the corners thereof, perforate panels forming the sides thereof and end heads, grooves in the rails receiving and retaining the longitudinal edges of adjacent perforate panels, interconnected recesses and grooves in the end heads receiving the end edges of the rails and panels and means securing the heads to the rails to form the rails, panels and heads in a tight assembly, said rails, heads and perforate panels being made of a thermoplastic resin, said perforate panels formed of separate substantially rectangular modules having a flat relatively thin perforate plate and intersecting reinforcing ribs upstanding therefrom, the lateral edges of the adjacent modules abutting each other in the final assembly.

2. The barrel of claim 1 wherein the thermoplastic resin is fiberglass-filled.

3. The barrel of claim 1 wherein the thermoplastic resin is mineral-filled.

4. The barrel of claim 2 wherein the crossed ribs include closely spaced double ribs along both longitudinal edges of each module, the ribs intersecting said double ribs including portions in the space between the double ribs and spaced along the lengths thereof, the grooves in the rails being dimensioned to receive one of the double ribs and the intersecting rib portions along the longitudinal edges to strengthen the connection between the rails and the longitudinal edges of the modules.

5. The barrel of claim 4 wherein the crossed ribs include closely spaced double ribs along at least one lateral edge of the module, the grooves in the end heads being dimensioned to receive one of the double ribs and the intersecting rib portions along the lateral edges of the end modules to strengthen the connection between the end heads and the modules.

6. The barrel of claim 4 wherein the grooves in the rails are dimensioned to receive both of the double ribs and intersecting rib portions therebetween along the longitudinal edges of the modules.

7. The barrel of claim 6 wherein the grooves in the end heads are dimensioned to receive both of the double ribs and intersecting ribs portions therebetween along the lateral edges of the end modules.

8. The barrel of claim 4 and additional longitudinal double ribs spaced at predetermined lateral locations of the module so that the module can be cut longitudinally at selected ones of said additional double ribs to shorten the module and thus provide polyhedral barrels of varying diameters.

9. The barrel of claim 2 wherein each module is formed with a tongue along one lateral edge thereof and a groove along the other lateral edge thereof for tonque and groove interconnection between adjacent modules.

10. The barrel of claim 2 wherein the abutting lateral edges of the modules are connected by welds.

* * * * *

UNITED STATES PATENT OFFICE
CERTIFICATE OF CORRECTION

Patent No. 4,014,774 Dated March 29, 1977

Inventor(s) Walter F. Noonan

It is certified that error appears in the above-identified patent and that said Letters Patent are hereby corrected as shown below:

Col. 2, line 2, Correct spelling of "thermoplastic".

Col. 5, line 39, "+1/2" should be ---30 1/2"---.

The word -- inch -- or -- inches -- should be inserted after the following figures indicated below.

Col. 1, line 16, after ---30 or 36---.

Col. 3, line 61, after ---30.5 or 36.5---.

line 68, after ---8 3/16---.

Col. 4, line 2, after ---1/8---.

line 4, after ---0.060---.

line 10, after ---3/8--- and ---1/8---.

line 12, after ---1/2---.

line 13, after ---0.10---.

line 15, after ---1/4---.

line 20, after ---1---.

line 22, after ---1/4---.

line 23, after ---1---.

line 25, after ---1/4--- and ---1---.

UNITED STATES PATENT OFFICE

CERTIFICATE OF CORRECTION

Patent No. 4,014,774 Dated March 29, 1977

Inventor(s) Walter F. Noonan

It is certified that error appears in the above-identified patent and that said Letters Patent are hereby corrected as shown below:

line 26, after ---1/4---.

Col. 4, line 31, after --- 1 x 1---.

line 55, after ---1/4--- (both occurrences).

line 56, after ---1/4 to 1/2---.

Col. 5, line 4, after ---1/4--- (both occurrences).

line 5, after ---1/2-1/4---.

lines 12, 13, after ---30 1/2 or 36 1/2---.

line 23, after ---1/2 x 1/2---.

line 24, after ---1/4 x 1/4---.

line 30, after ---1/2 x 1/2---.

line 39, after ---36 1/2---.

line 53, after ---30---, ---36---, ---14---, ---16---.

line 56, after ---8 3/16---.

line 63, after ---7---.

line 64, after ---7 1/8---.

line 65, after ---6 1/8---.

UNITED STATES PATENT OFFICE

CERTIFICATE OF CORRECTION

Patent No. 4,014,774 Dated March 29, 1977

Inventor(s) Walter F. Noonan

It is certified that error appears in the above-identified patent and that said Letters Patent are hereby corrected as shown below:

Col. 6, line 8, after ---8 1/2 x 6.090 x 1/2---.

Col. 7, line 25, after ---36 1/2---.

line 32, after ---36 1/2---.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*